United States Patent [19]

Newman et al.

[11] 4,117,852

[45] Oct. 3, 1978

[54] METHOD AND APPARATUS FOR RECLAIMING TOBACCO FROM CIGARETTES

[75] Inventors: Thomas A. Newman, Midlothian; Erich O. Kettner, Richmond, both of Va.

[73] Assignee: Philip Morris Incorporated, New York, N.Y.

[21] Appl. No.: 719,473

[22] Filed: Aug. 31, 1976

[51] Int. Cl.[2] ..... A24C 5/36

[52] U.S. Cl. ..... 131/96

[58] Field of Search ..... 131/96, 20 R, 20 A, 131/20 B, 21 R, 27 R, 55, 70, 74, 136, 23 R, 23 A

[56] References Cited

U.S. PATENT DOCUMENTS

| | | | |
|---|---|---|---|
| 1,784,296 | 12/1930 | Lorentz | 131/20 R |
| 2,976,872 | 3/1961 | Morphet et al. | 131/96 |
| 3,026,880 | 3/1962 | Perrin | 131/23 A |
| 3,103,222 | 9/1963 | Di Ianni | 131/96 |
| 3,160,161 | 12/1964 | Sandman | 131/96 |
| 3,255,762 | 6/1966 | Baier | 131/21 R |
| 3,339,559 | 9/1967 | Rupert | 131/96 |
| 3,366,125 | 1/1968 | Jackson | 131/96 |
| 3,577,998 | 5/1971 | Pinkham | 131/96 |
| 3,577,999 | 5/1971 | Pinkham | 131/96 |
| 3,665,931 | 5/1972 | Mizzau | 131/21 R |
| 3,677,068 | 7/1972 | Schmermund | 131/21 B |
| 3,757,799 | 9/1973 | Di Ianni | 131/96 |

*Primary Examiner*—Robert W. Michell
*Assistant Examiner*—V. Millin
*Attorney, Agent, or Firm*—Arthur I. Palmer, Jr.; G. Esler Inskeep; Susan A. Hutcheson

[57] ABSTRACT

The present invention relates to reclaiming tobacco and paper from cigarettes. The apparatus of the invention entails a structural frame which carries a hopper intended to temporarily store a supply of cigarettes. Suitable conveying means connected to the frame convey the cigarettes consecutively from the hopper to sequential points of treatment. The tobacco is removed from each cigarette by an intermediate air jetting means connected to the frame at an intermediate station. Air from the jetting means is introduced into a receiving end of each cigarette as the cigarette is conveyed past the intermediate station so that the tobacco is ejected from the surrounding paper tube of the cigarette. Pneumatic aligning means connected to the frame at a first station consecutively aligns the cigarettes relative to the conveying means to assure direct proximity of the receiving end of each cigarette to the intermediate jetting means. Recovering means connected to the frame serve to collect tobacco and the remaining paper tube from each cigarette.

The method of the invention involves withdrawing cigarettes consecutively from a hopper and thereafter pneumatically aligning each cigarette relative to a conveying system. A receiving end of each cigarette is placed in axially abutting relation with a sealing plate supplied with air under pressure. A jet of air is directed from an orifice in the sealing plate through the receiving end of each cigarette to eject the tobacco from the surrounding paper tube of the cigarette. The paper tube remaining after the tobacco has been removed from each cigarette is pneumatically ejected into a chute. The tobacco removed from each cigarette and each remaining paper tube are separately conveyed to locations for further processing.

11 Claims, 9 Drawing Figures

METHOD AND APPARATUS FOR RECLAIMING TOBACCO FROM CIGARETTES

BACKGROUND OF THE INVENTION

The present invention relates generally to a method and apparatus for reclaiming tobacco and paper from cigarettes. More particularly, the invention relates to a method and apparatus for reclaiming tobacco and paper from cigarettes which, by a unique pneumatic treatment of the cigarettes, avoids degradation of either the tobacco or its surrounding paper tube.

The tobacco industry has developed from an era in which fairly small producers provided essentially only loose tobacco to their customers, to its present state of being an intensely competitive business serving highly discriminating consumers. Though loose tobacco is still produced and marketed, the great bulk of the productive capacity of the industry is directed toward the production and marketing of cigarettes. Under the highly competitive circumstances existing in the tobacco industry and in light of the highly discriminating character of cigarette consumers, it is essential that very high standards of quality control be imposed and carefully maintained over the production of cigarettes. Cigarettes ultimately marketed must be of uniformly high quality.

Numerous factors contribute to the quality of a cigarette and each must be monitored as the cigarettes are produced. For example, the moisture content of tobacco must be carefully maintained at a desired level. The size and relative proportions of the particles of tobacco filler must be controlled with precision. Similarly, such other factors as density of the tobacco filler contained within each cigarette must be carefully controlled. And, as will be readily apparent, any cigarettes which become physically damaged in the manufacturing process must be rejected. Though the matter is greatly complicated by the vast numbers of cigarettes which must be produced, certain manufacturers have been singularly successful in imposing high standards of quality on the products marketed.

The practice of successful control of the quality of cigarettes reaching the consuming public involves rejecting (i.e., selectively removing) a substantial number of cigarettes which are imperfectly formed in the manufacturing process. While these cigarettes could perhaps be discarded in the interest of economy and ecology, certain manufacturers have undertaken to recycle their tobacco and paper contents. The methods employed thus far have been somewhat satisfactory but nonetheless leave much to be desired as far as the quality of the reclaimed products and the total efficiency of the operation are concerned.

Typically the devices employed in the prior art to reclaim tobacco and paper involve rotating and moisturizing the rejected cigarettes within a rotatable drum. The cigarettes thereafter are broken up and the resultant mix screened to partially separate the tobacco and paper. The remaining tobacco and paper are successively passed through a series of rotating blades and cyclone separators to complete separation. While this process is relatively effective in simply separating the tobacco from the paper, it possesses several disadvantages.

A principal disadvantage of the process resides in the fact that the paper, and more importantly the tobacco, undergo substantial degradation. The paper is shredded to a significant degree and the relative amount of fine particles of tobacco is increased. Thus, the recovered tobacco is less suitable for use in new cigarettes, and the paper is thus more difficult to handle for purposes of recycling. Additionally, the moisture content of the recovered tobacco ordinarily has to be adjusted to achieve the proper level before the tobacco can be reused.

Certain of the foregoing disadvantages can be avoided by pneumatically forcing tobacco from the surrounding paper tubes of cigarettes without comminuting or otherwise significantly damaging the paper and tobacco. This approach has been attempted in the prior art in a number of instances, but significant new problems have developed. Many of these problems spring from the difficulties inherent in individually handling large numbers of cigarettes. For instance, in order to properly pneumatically eject tobacco from the interior of a cigarette, each cigarette must be accurately positioned relative to the various elements of the system. This positioning, and in particular the axial position of each cigarette relative to an air orifice has been accomplished mechanically in the prior art. This approach has tended in some cases to damage the ends of the cigarettes thus hampering complete ejection of the filler from individual cigarettes. Mechanical alignment has thus proven to be somewhat unsatisfactory.

In pneumatically ejecting tobacco from cigarettes, it is important for optimum operation that the portion of the cigarette to receive the charge of air intended to eject the tobacco be well sealed with the element of the machine producing the charge of air. In many devices of the prior art, there is no direct seal between the cigarette and the element of the mechanism producing the charge of air. As a result, a portion of the pressure differential otherwise available for ejecting tobacco is dissipated, the efficiency of the reclaiming apparatus is diminished.

With only a prescribed amount of air pressure available for ejecting tobacco from the cigarettes, an unrestricted flow path from the portion of the cigarette receiving the air jet to the open end of the cigarette from which the tobacco is ejected is highly important. If the flow path is restricted to some degree, a portion of the air pressure must first be expended in overcoming the restriction. Only the air pressure remaining after the restriction has been passed is available for ejecting tobacco. Inasmuch as certain of the devices of the prior art entail restriction of the flow path through the cigarettes, these devices are inherently less effective than if the flow path were unrestricted.

Typically, the devices of the prior art employing air pressure to eject tobacco from cigarettes involve a jet of air applied to one end of the cigarette in order to eject the tobacco from the opposite end. In order to effectively apply the jet of air to an end of a cigarette, the cigarette must be properly restrained from axial translation away from the jet of air. Certain of the devices of the prior art have been somewhat deficient in this regard and have failed to satisfactorily restrain the cigarettes as a jet of air is applied. As a result, the efficiency of the devices has been less than optimal.

Other devices involving the pneumatic ejection of tobacco from cigarettes require that the operation be performed within impractically close tolerances. One device in particular requires that a cigarette fit quite precisely within the confines of a groove so that a needle can be inserted at the interface between the mouthpiece and the body of the cigarette. Inasmuch as the air pressure is introduced into the cigarette through the needle, the needle must pierce the cigarette at a relatively precise point to avoid incomplete ejection of tobacco from the surrounding paper tube. Other devices of the prior art entail analogous problems of excessively close working tolerances and thus tend to be less than optimal systems.

Numerous other serious problems are presented by the various devices of the prior art. These problems should readily occur to those skilled in the art and are among many which tend to reduce the effectiveness and desirability of methods and apparatus intended to reclaim tobacco and paper from cigarettes. The foregoing presentation of specific problems encountered with devices of the prior art should thus not be construed as exhaustive or even necessarily representative. The problems discussed are exemplary only. Nonetheless, the discussion should suffice to satisfactorily demonstrate that the devices of the prior art intended to reclaim tobacco and paper from cigarettes have been less than entirely satisfactory.

OBJECTS AND SUMMARY OF THE PREFERRED FORMS OF THE INVENTION

In light of the foregoing, a general object of the invention is to obviate or minimize problems of the type noted.

A more particular object of the invention is to accomplish the recovery of the tobacco and paper of cigarettes without unduly degrading the tobacco.

Another object of the invention resides in effectively recovering the tobacco and paper of cigarettes without significantly degrading the paper.

Still another object of the invention is to provide an effective system for reclaiming tobacco and paper from cigarettes in which the paper is recovered in a form which can be easily handled.

Yet still another object of the invention is to reclaim the tobacco and paper from cigarettes in such a way that substantially complete separation is obtained.

A further object of the invention is to provide an efficient mode of reclaiming tobacco and paper from cigarettes without allowing the tobacco to undergo undesirable changes in moisture content.

A still further object of the invention is to provide a system for effectively handling and aligning cigarettes without damaging the cigarettes in such a way that it is more difficult to eject the tobacco from the surrounding paper tubes.

A yet still further object of the invention is to provide an effective seal between the end of each cigarette receiving a jet of air and the element of the invention developing the jet.

Yet another object of the invention is to afford a relatively unrestricted flow path from the end of each cigarette intended to receive a jet of air to the end of the cigarette from which the tobacco is to be ejected.

Yet still another object of the invention is to afford a system for pneumatically ejecting tobacco from cigarettes in which each cigarette is positively engaged and restrained in a manner avoiding unnecessary damage to the paper while a jet of air is applied to one end of the cigarette.

Yet a further object of the invention is to afford a system for pneumatically ejecting tobacco from cigarettes without involving unduly close working tolerances between the cigarettes and the various elements of the system.

An apparatus according to the present invention intended to meet the foregoing objectives entails a structural frame which carries a hopper intended to temporarily store a supply of cigarettes. Suitable conveying means connected to the frame convey rejected cigarettes consecutively from the hopper to points of treatment involved in removing the tobacco from the surrounding paper tube of the cigarette. The tobacco is removed from each cigarette by an intermediate air jetting means connected to the frame at an intermediate station. Air from the jetting means is introduced into a receiving end of each cigarette as the cigarette is conveyed past the intermediate station so that a sufficient pressure differential is developed across the length of the cigarette that the tobacco is ejected from the surrounding paper tube of the cigarette. Pneumatic aligning means connected to the frame at a first station consecutively aligns the cigarettes relative to the conveying means to assure direct proximity of the receiving end of each cigarette to the intermediate jetting means. Recovering means connected to the frame serve to collect tobacco ejected from each cigarette and to thereafter collect the remaining paper tube.

A method according to the present invention likewise intended to meet the foregoing objective involves withdrawing cigarettes consecutively from a hopper and thereafter pneumatically aligning each cigarette relative to a conveying system. A receiving end of each cigarette is next essentially hermetically sealed in axially abutting relation with sealing plate supplied with air under pressure. A jet of air is directed from an orifice in the sealing plate through the receiving end of each cigarette to develop a sufficient pressure differential across the length of the cigarette that the tobacco is ejected from the surrounding paper tube of the cigarette. The paper tube remaining after the tobacco has been removed from each cigarette is pneumatically ejected into a chute. The tobacco removed from each cigarette and each remaining paper tube are finally separately conveyed to remote storage locations.

DRAWINGS

Other objects and advantages of the method and apparatus of the invention will become apparent with reference to the detailed description to follow of a preferred embodiment thereof. The preferred embodiment is illustrated in a number of appended drawings in which like reference numerals refer to like elements and in which.

DETAILED DESCRIPTION

General Overview

Figure 1:
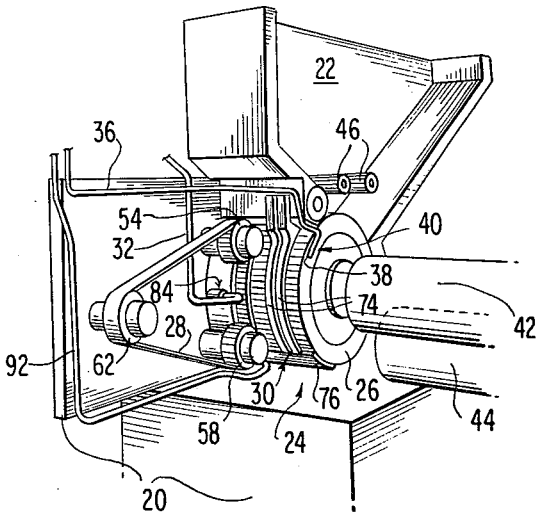
FIG. 1 is an environmental perspective of a preferred embodiment of the invention.

Referring now generally to the drawings but in particular to FIG. 1, a preferred embodiment of the invention can be seen. The invention requires a suitable frame 20 to support the various functional elements. A suitable hopper 22 is carried by the frame in the somewhat elevated posture shown. The hopper 22 is employed to temporarily store a supply of cigarettes 23 and may assume any configuration found satisfactory.

A suitable conveying means located generally at 24 conveys cigarettes consecutively from the hopper 22 to selected points of treatment to remove the tobacco from the surrounding paper tube of each cigarette. The conveying means can assume any satisfactory form but preferably involves at least a fluted, rotary drum 26; a flexible, gripping belt 28 with associated pulleys; and an arcuate retainer 30 which assists the belt 28 in maintaining cigarettes in place.

Intermediate air jetting means 32 of a suitable form is connected to the frame 20 at an intermediate station 34 for the purpose of introducing a jet of air into a receiving end of each cigarette as the cigarette is conveyed past the intermediate station 34 by the conveying means 24. The intermediate jetting means is intended to develop a sufficient pressure differential across the length of the cigarette to eject the tobacco from the surrounding tube. The tobacco thus ejected can be thereafter reclaimed for subsequent reuse.

In order for the intermediate air jetting means to successfully eject the tobacco from each cigarette, each cigarette must be properly positioned. Thus, pneumatic positioning means, preferably in the form of an air line 36 and nozzle 38 are provided. The nozzle 38 is connected to the frame at a first station 40 and functions to consecutively position the rejected cigarettes relative to the conveying means 24. This positioning assures direct proximity of the receiving end of each cigarette to the intermediate jetting means so that tobacco can be successfully ejected from the surrounding paper tube.

In order to fully and conveniently recover the tobacco and paper from the cigarettes, recovering means are provided for the tobacco and paper. Though the recovering means can assume any satisfactory form, chutes 42 and 44 for collecting the tobacco and paper, respectively, are preferred. The tobacco chute 42 is employed to collect the tobacco as it is ejected from the surrounding paper tube of each cigarette. The paper chute 44 is employed to collect the remaining paper tubes.

The Frame and Hopper

As indicated earlier, the frame 20 and hopper 22 can each assume any satisfactory form. The frame need only be capable of sustaining the various functional elements of the invention in the necessary spatial array. The hopper similarly can be of any satisfactory form. However, for optimal performance, the hopper should permit the cigarettes to flow without undue interruption into the conveying means 24. Thus, the hopper should be of a form which avoids such problems as bridging. To this end, the configuration illustrated in the various FIGS., equipped with the pegs 46, has been found to be satisfactory. The hopper may also be vibratory if desired.

The Conveying Means

Figure 2:
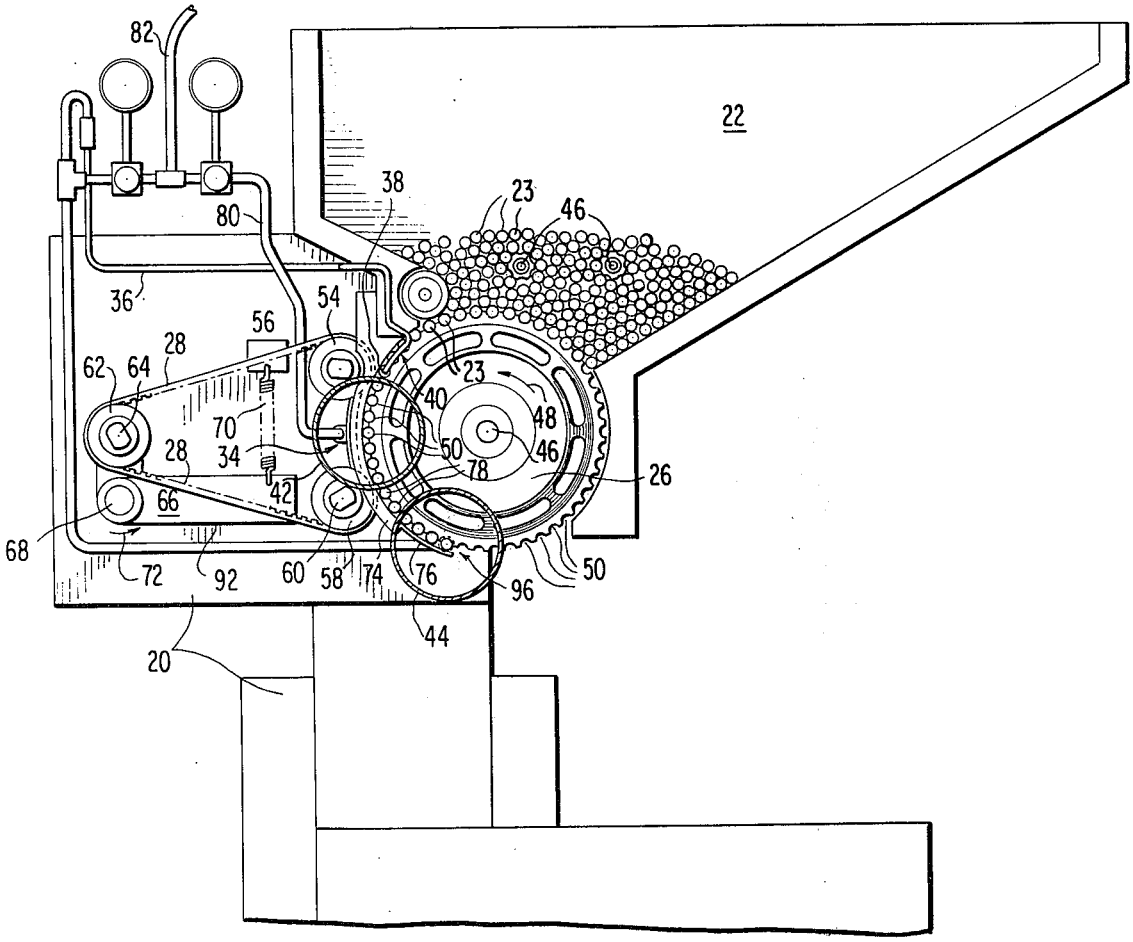
FIG. 2 is a frontal view of a preferred embodiment of the invention.
Figure 4:
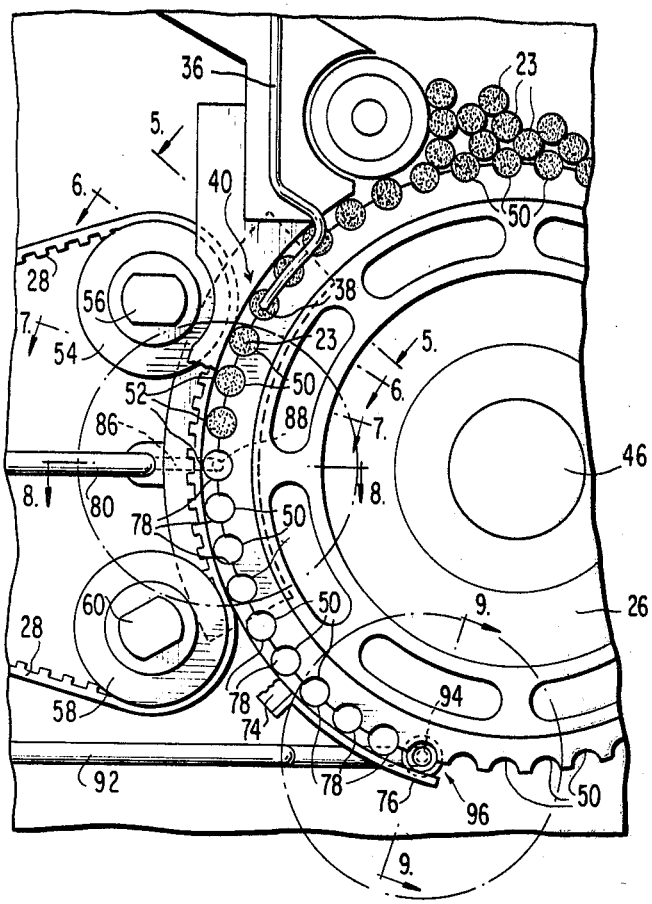
FIG. 4 is an enlarged, segmental frontal view of the preferred embodiment of the invention illustrated in FIG. 2.

Suitable conveying means 24 must be provided to convey cigarettes consecutively from the hopper 22 to points of treatment to remove the tobacco from the surrounding paper tube. As indicated earlier and as illustrated in FIGS. 1 and 2, the conveying means preferably is comprised of a fluted rotary drum 26; a flexible, gripping belt 28 with associated pulleys; and an arcuate retainer 30 which assists the belt 28 in maintaining the cigarette in place. The rotary drum 26 is pivotally mounted on the frame 20 through an axle 46 and is driven in a counterclockwise direction as indicated by the arrow 48 appearing in FIG. 2. The drum 26 carries a plurality of uniformly sized and spaced flutes or grooves 50 about the outer circumference. Each groove extends in a direction parallel to the axis of rotation of the drum and is sized to carry a cigarette 23 from which the tobacco and paper are to be reclaimed. The particular manner in which the flutes 50 each carry a cigarette 23 can perhaps best be appreciated from an examination of FIGS. 2 and 4. Each cigarette is nested in one of the flutes 50. As illustrated in FIG. 4, the fluted drum 26 is carried by the frame immediately beneath the open bottom of the hopper 22. Thus, as the drum rotates, the flutes 50 receive rejected cigarettes 23 consecutively from the hopper. Each flute receives only a single, individual cigarette.

Figure 3:
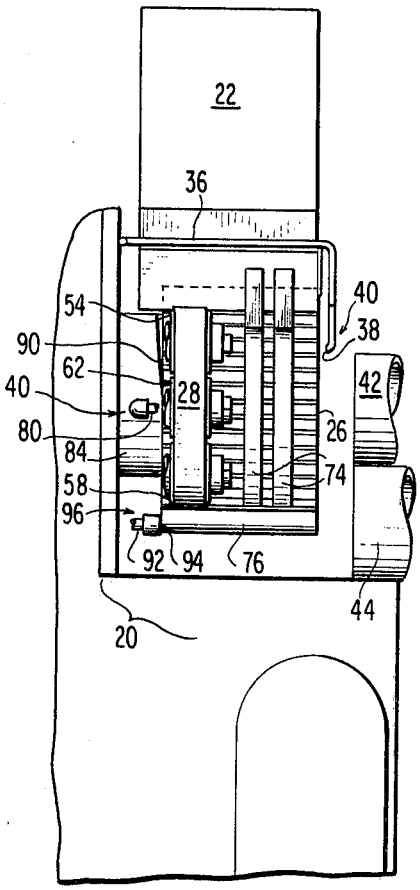
FIG. 3 is a side view of a preferred embodiment of the invention.

The conveying means also includes a suitable flexible gripping means, preferably in the form of the belt 28 illustrated in FIGS. 2, 3, and 4. The belt 28 is juxtaposed to an arcuate segment of the drum 26 to grip and axially restrain rejected cigarettes which have been received by and positioned relative to the drum 26. As perhaps best illustrated in FIG. 4, the belt 28 actually contacts cigarettes 23 held within flutes 50 of the drum 26 at points of contact 52. The belt exerts sufficient lateral pressure against the sides of the cigarettes 23 to restrain these cigarettes against axial movement parallel to the length of the flutes 50. The cigarettes can thus be properly restrained without being torn while the tobacco of each is ejected. The pressure differential developed across the length of each cigarette is thus less likely to be diminished due to leakage. Also, the cigarettes can be restrained without having the flow path therethrough constricted.

As illustrated in FIG. 2, the belt 28 is trained around pulleys. These pulleys include a first idling pulley 54 pivotally mounted on an axle 56 adjacent the drum 26, a second idling pulley 58 also pivotally mounted on an axle 60 adjacent the drum, and a third idling pulley 62 pivotally mounted on an axle 64 disposed on one arm of a bellcrank 66. The bellcrank 66 is in turn pivotally mounted on an axle 68 depending from the frame 20. The remaining arm of the bellcrank 66 is resiliently connected with the frame 20 through a tension spring 70. The tension spring 70 tends to rotate the bellcrank 66 in a counterclockwise direction as indicated by the arrow at 72 and thus tends to lever the third pulley 62 away from the first and second pulleys 54 and 58, respectively. The tendency of the third pulley 62 to move away from the first and second pulleys 54 serves to tighten the belt 28 so as to maintain the desired lateral pressure on the cigarettes 23. The cigarettes are thus effectively restrained against the axial movement when in contact with the belt 28.

The conveying means 24 also includes suitable arcuate retaining means 30 preferably in the form of arcuate retaining arms 74 and an arcuate retaining pan 76 as illustrated in FIGS. 1, 2, 3, and 4. The arms and pan are connected to the frame 20 and together extend in essentially coextensive relation to the belt 28 in juxtaposition to the drum 26. The arms 74 and pan 76, however, extend somewhat beyond the belt 28 in the direction of the rotation of the drum as most clearly shown in FIG. 4. The arms 74 and pan 76 thus serve to retain the paper tubes 78 of the cigarettes in the fluting of the drum after the tobacco has been ejected and after the tubes have progressed with the drum beyond the arcuate segment associated with the belt 28. The tubes are thus retained in the flutes 50 after having moved from contact with the belt 28 preparatory to recovery by the recovering means. Thus, though the tubes 78 are free to move axially, parallel to the flutes 50, they remain relatively fixed against lateral movement even though no longer in contact with belt 28.

The Intermediate Jetting Means

Tobacco is ejected from each cigarette by a jet of air which develops a sufficient pressure differential across the length of each cigarette to force the tobacco from within the surrounding paper tube. The pressure differential, however, is not sufficiently great to burst the paper tubes and is developed by the intermediate jetting means.

As indicated earlier and as best illustrated in FIGS. 1, 2, 3, and 4, the intermediate jetting means is connected to the frame 20 at an intermediate station 34. The jetting means preferably includes an air line 80 connected with a suitable source of air pressure 82. The air line 80 passes to a sealing plate 84 perhaps best shown in FIG. 3 and connects with an air passage 86 disposed in the sealing plate 84 and shown in broken lines in FIG. 4. The air passage 86 terminates in a jetting orifice 88 also illustrated in broken lines in FIG. 4. The jetting orifice is positioned at the intermediate station 34 to periodically register with each flute 50 of the drum 26 as the drum rotates. Since each flute is carrying a rejected cigarette at the point of registry shown in FIG. 4 and since a jet of air is directed from the jetting orifice, the jet of air is introduced into a receiving end of each cigarette conveyed by the drum 26. Because each cigarette is restrained from axial movement by the belt 28, a pressure differential develops across the length of the cigarette of sufficient magnitude to eject the tobacco from the surrounding paper tube. This relatively simple but effective manner of handling the tobacco affords the twofold advantage that the tobacco is neither mechanically degraded nor is the moisture content undesirably changed.

The Pneumatic Positioning Means

In order for the intermediate jetting means to satisfactorily eject tobacco from the cigarettes, each cigarette must be properly positioned so that the receiving end is in direct proximity to the jetting orifice 88 of the intermediate jetting means. The invention is thus provided with a pneumatic positioning means. As illustrated in FIGS. 3 and 4, the pneumatic positioning means preferably includes an air line 36 and an air nozzle 38, the air line being connected to a source of air pressure 82. The pneumatic positioning means is thus comprised of an initial air jetting means in the form of an air nozzle 38 which directs an initial jet of air against the end of each cigarette opposite the end to receive a jet of air from the jetting orifice 88 of the intermediate air jetting means. Since the cigarette impinged by the jet of air from the nozzle 38 is not yet in contact with the belt 38 but rather is only resting freely in a flute 50 of the drum 26, the jet from the nozzle 38 serves to translate each cigarette axially relative to the conveying means. In this way, damage to the ends of the cigarette often occuring in the course of mechanical positioning is avoided. Ultimately, the receiving end of each cigarette comes into abutment with the frontmost surface of the sealing plate 84 and is properly initially positioned to receive air from the jetting orifice 88.

The Sealing Means

In order for the tobacco of the cigarettes to be effectively ejected from within the surrounding paper tubes, there should be an essentially hermetic seal between the receiving end of each cigarette and the jetting orifice 88 illustrated in FIG. 4. This is accomplished by the sealing means as each cigarette is conveyed past the orifice. The sealing means is comprised of the frontmost, inclined surface 90 of the sealing plate 84. As can be readily appreciated from an examination of FIG. 3, this frontmost surface is inclined from top to bottom toward the drum 26. The inclined surface 90 effects the desired seal between the receiving end of each cigarette and the orifice 88 because the cigarettes become progressively more firmly pressed against the surface as they are conveyed by the drum 26. The maximum pressure is reached as each cigarette passes over the orifice 88. Inasmuch as the jetting orifice is smaller in diameter than the cigarettes, the receiving end of each cigarette is essentially hermetically sealed with the sealing plate and thus the jetting orifice.

The forementioned pressure is developed as an incident of the movement of the cigarettes with the drum 26. As the cigarettes each initially enter a flute of the drum, they are relatively free to translate axially. Thus, each cigarette can be axially translated by the pneumatic positioning means so that the receiving end of the cigarette abuts the inclined surface 90. At this point, the inclined surface is spaced significantly apart from the drum relative to a recently positioned cigarette. Subsequently, each cigarette is engaged and restrained against axial translation by the belt 28. Thereafter, the inclined surface 90, relative to a particular cigarette, steadily approaches the drum 26 as the drum rotates and the receiving ends of consecutive cigarettes are pressed progressively more firmly against the inclined surface. This pressure reaches a maximum for a particular cigarette as the cigarette passes over the jetting orifice 88. An effective, essentially hermetic seal thus exists between the receiving end of the cigarette and the surface surrounding the orifice 88 and the tobacco of the cigarette can be effectively ejected from within the surrounding paper tube.

The Recovering Means

The tobacco ejected from each cigarette is to be recovered and likewise the remaining paper tubes are to be collected and recovered. The invention thus provides recovering means as illustrated in FIG. 3. Though the recovering means can assume any satisfactory form, it preferably entails a tobacco chute 42. The tobacco chute 42 is disposed opposite the intermediate station 34 where the intermediate air jetting means functions to eject tobacco from consecutive cigarettes. Thus, as the tobacco is ejected from each cigarette, it is received by the tobacco chute 42 for conveyance to a remote storage location.

While the tobacco is ejected from each cigarette and projected into the tobacco chute 24, the remaining paper tubes 78 continue to travel in the flutes 50 of the drum 26. Soon after the tobacco is ejected, the tubes move out of contact with the belt 28. However, though the paper tubes are free to translate axially once out of contact with the belt 28 they remain within the retaining arms 74 and pan 76 and thus continue to be restrained against lateral movement. In this posture, the tubes move past final air jetting means intended to axially eject the empty paper tubes 78 from the flutes 50.

The final air jetting means preferably takes the form of an air line 92 connected to a suitable source of air pressure 82 and an air nozzle 94 which terminates the line 92. As illustrated in FIGS. 2, 3, and 4, the nozzle 94 occupies a third station 96 which is periodically in registry with each flute 50 of the drum 26. The jet of air exiting the nozzle 94 thus impinges upon the receiving end of each now empty cigarette to eject the tube axially from the associated flute of the drum 26. This unique treatment of the tube avoids any mechanical degradation of the paper. The paper can thus be more easily handled for recycling.

A paper chute 44 is disposed opposite the third station 96 and receives each paper tube as the tube is ejected from a flute of the drum by the final jet of air from the nozzle 94. Once received by the paper chute, the empty paper tubes of the cigarettes can be conveyed to a remote location.

The Operation of the Invention

Figure 8:
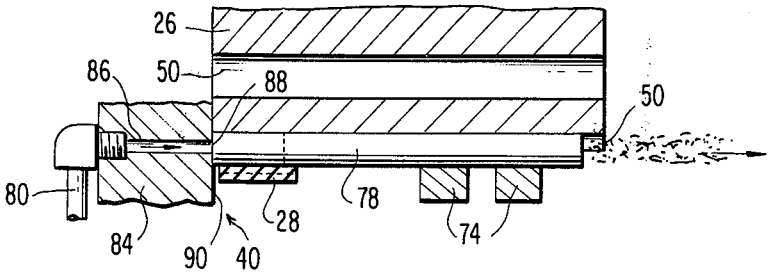
FIG. 8 is a partial sectional view taken along the lines 8—8 of FIG. 4.
Figure 9:
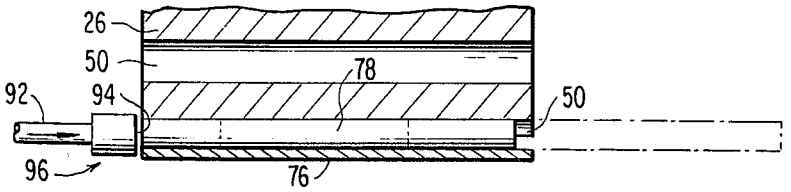
FIG. 9 is a partial sectional view taken along the lines 9—9 of FIG. 4.

The operation of the invention can be perhaps better understood upon examination of FIGS. 8 and 9. These drawings are partial sectional views taken along the respective section lines shown in FIG. 4 and show the relative position of a cigarette and the remaining paper tube thereof as the cigarette is conveyed by the drum 26 and treated by the invention. In each FIG., the drum 26 appears with its characteristic flutes 50. Additionally, either a cigarette 23 or an empty paper tube 78 is illustrated in each FIG. Also, either the retaining arms 74 or the retaining pan 76 is shown.

Figure 5:
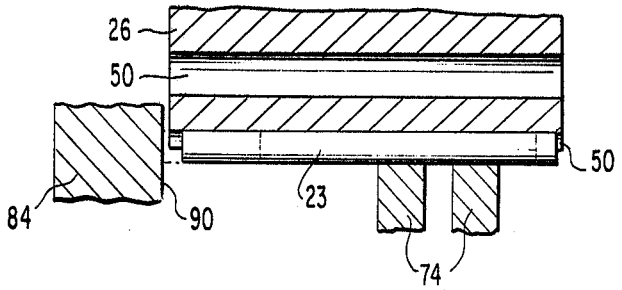
FIG. 5 is a partial sectional view taken along the lines 5—5 of FIG. 4.
Figure 6:
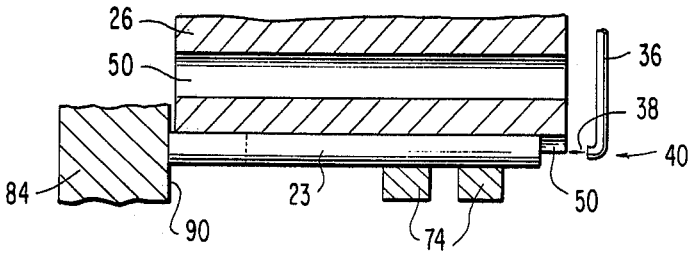
FIG. 6 is a partial sectional view taken along the lines 6—6 of FIG. 4.
Figure 7:
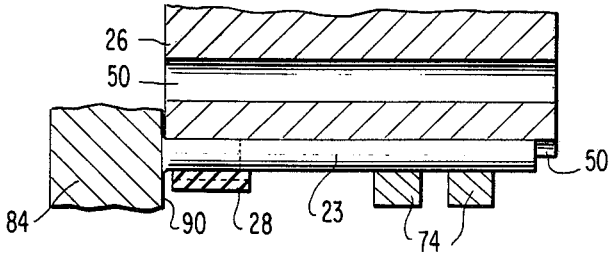
FIG. 7 is a partial sectional view taken along the lines 7—7 of FIG. 4.

FIG. 5 illustrates the posture of a cigarette 23 which has just recently passed from the hopper into a flute 50 of the drum 26. At this point, the cigarette is laterally restrained by the arms 74 and the walls of the flute but is axially unrestrained. The receiving end of the cigarette is out of contact with the inclined surface 90 of the sealing plate 84. As the drum rotates, the cigarette reaches the initial station 40 where a jet of air from the nozzle 38 of the pneumatic positioning means impinges upon the end of the cigarette opposite that to receive the air intended to eject the tobacco. As a result of the force exerted by the air jet, the cigarette is translated axially into abutment with the inclined surface 90 of the sealing plate 84. Though the cigarette at this point is unrestrained axially, the restraining arms 74 continue to restrain the cigarette laterally.

As the drum 26 continues to rotate, belt 28 engages and restrains the cigarette against axial movement while the inclined surface 90 appears to move closer to the drum relative to a given cigarette. Because the end of the cigarette was earlier moved into abutment with the inclined surface 90 and because relatively the surface moves close to the drum, the end of the cigarette to receive a jet of air to eject the tobacco becomes pressed progressively more tightly against the inclined surface 90. When the end of the cigarette reaches the intermediate station in registry with the jetting orifice 88 of the intermediate air jetting means, the cigarette has become pressed against the inclined surface 90 with such firmness than an essentially hermetic seal has been developed between the end of the cigarette and the jetting orifice 88. The air pressure introduced through the air line 80 and air passage 86 can thus be effectively applied to the receiving end of the cigarette to eject the tobacco from within the surrounding paper tube. Ultimately the ejected tobacco is projected from the cigarette to reach the tobacco chute 42 shown in FIG. 1.

Once the tobacco has been ejected from a cigarette, only an empty paper tube 78 remains. This paper tube continues to be conveyed by the drum 26. Ultimately, the tube reaches the final station 46 shown in FIG. 9. At this point, the belt 28 no longer restrains the tube axially, though the retaining pan 76 continues to retain the cigarette laterally. The end of the tube is now moved to registry with the nozzle 94 of the final air jetting means and the jet of air impinging upon the receiving end of the tube serves to translate and eject the tube axially from the flute of the drum. Ultimately, the now empty paper tube enters the paper chute 44 for conveyance to a remote storage location.

At this point, it can be clearly understood that the invention affords a novel and highly effective approach to reclaiming tobacco and paper from cigarettes. The cigarettes are consecutively withdrawn from a hopper and pneumatically positioned relative to a conveying system. A receiving end of each cigarette is next essentially hermetically sealed with a sealing plate carrying air under pressure. This sealing is accomplished by axially restraining each cigarette relative to the sealing plate with a continuous elastomeric belt and thereafter laterally translating each cigarette from abutment with a first location on the sealing plate to a second location closer to the end of the cigarette opposite the receiving end. The cigarette is thus relatively tightly in abutment with the sealing plate. A jet of air is next directed from an orifice in the sealing plate through the receiving end of each tightly sealed cigarette. A sufficient pressure differential is developed by the jet across the length of the cigarette to eject the tobacco from the surrounding paper tube. Once removed from the cigarette, the tobacco can be transported to a remote storage location.

The paper tubes remaining after the tobacco has been ejected can next be pneumatically ejected into a paper chute. This can be accomplished by first releasing each tube from axial restraint while restraining each tube laterally. Ultimately, a jet of air can be directed against the receiving end of the tube to eject the tube from the associated flute of the drum into the chute. The paper tubes can thereupon be conveyed to a remote storage location.

SUMMARY OF THE ADVANTAGES OF THE INVENTION

It will be appreciated that, in providing the method and apparatus for reclaiming tobacco and paper from cigarettes according to the invention, certain significant advantages are obtained.

A particular advantage of the invention is that the tobacco and paper of cigarettes are recovered without unduly degrading the tobacco.

Another advantage of the invention resides in the fact that the tobacco and paper of cigarettes are effectively recovered without significantly degrading the paper.

Still another advantage of the invention accrues from the fact that the system reclaims tobacco and paper from cigarettes in such a way that the paper is recovered in a form which can be easily handled.

Yet still another advantage of the invention is that the tobacco and paper from cigarettes are reclaimed in such a way that the paper and tobacco are readily separated from each other.

A further advantage of the invention resides in the fact that tobacco and paper from cigarettes are effectively reclaimed without allowing the tobacco to undergo undesirable changes in moisture content.

A still further advantage of the invention accrues from the fact that the system effectively handles and aligns the cigarettes without damaging them and thus making it more difficult to eject the tobacco from the surrounding paper tubes.

A yet still further advantage of the invention is that an effective seal is developed between the end of each cigarette receiving a jet of air and the element of the invention developing the jet.

Yet another advantage of the invention resides in the fact that a relatively unrestricted flow path is afforded from the end of the cigarette from which the tobacco is to be ejected.

Yet still another advantage of the invention is that the system pneumatically ejects the tobacco while each cigarette is positively engaged and restrained in a manner avoiding unnecessary damage to the paper.

Yet a further advantage of the invention accrues from the fact that the system pneumatically ejects tobacco from cigarettes without involving unduly close working tolerances between the cigarettes and the various elements of the system.

In describing the invention, reference has been made to a preferred embodiment. However, those skilled in the art and familiar with the disclosure of the invention may recognize additions, deletions, substitutions, or other modifications which would fall within the purview of the invention as defined in the following claims.

What is claimed is:

1. An apparatus for reclaiming tobacco from cigarettes comprising:

(a) a structural frame;

(b) a hopper carried by said frame for temporarily storing a supply of cigarettes;

(c) conveying means connected to said frame for conveying said cigarettes consecutively from said hopper to points of treatment to remove the tobacco from its surrounding paper tube of each cigarette;

(d) intermediate air jetting means connected to said frame at an intermediate station for introducing a jet of air into a receiving end of each cigarette as the cigarette is conveyed past said intermediate station by said conveying means, a sufficient pressure differential being developed across the length of the cigarette to eject the tobacco from the surrounding paper tube thereof, said air jetting means being comprised of a sealing plate, an air passage disposed in said sealing plate and supplied with air under pressure, and a jetting orifice terminating said passage;

(e) pneumatic positioning means connected to said frame at a first station for consecutively positioning the cigarettes relative to said conveying means to assure direct proximity of said receiving end of each cigarette to said intermediate air jetting means so that the tobacco is ejected from the surrounding paper tube of the cigarette;

(f) sealing means connected to said frame for effecting an essentially hermetic seal between said intermediate air jetting means and said receiving end of each cigarette as the cigarette is conveyed past said air jetting means, said sealing means being comprised of an inclined surface of said sealing plate, against which each cigarette is progressively more firmly pressed as the cigarette is conveyed by said conveying means, said inclined surface surrounding said jetting orifice; and (g) recovering means connected to said frame for collecting the tobacco ejected from the surrounding paper tubes of the cigarettes.

2. An apparatus for reclaiming tobacco from cigarettes as defined in claim 1 wherein said conveying means (c) is comprised of:

an axially fluted rotating drum carried by said frame immediately beneath said hopper, the fluting of said drum being configured to receive cigarettes consecutively from said hopper as said drum rotates, each flute of said fluting receiving an individual cigarette; and flexible gripping means juxtaposed to an arcuate segment of said drum for gripping and axially restraining the cigarettes once received by said fluting of drum and positioned relative to said conveying means by said pneumatic positioning means.

3. An apparatus for reclaiming tobacco from cigarettes as defined in claim 2 wherein once positioned relative to said conveying means by said pneumatic positioning means, each cigarette is maintained axially in a relatively stationary posture within a flute of said drum while said receiving end is pressed progressively more firmly against said inclined surface of said sealing plate to effect a relatively hermetic seal therebetween.

4. An apparatus for reclaiming tobacco from cigarettes as defined in claim 2 wherein said conveying means (c) is further comprised of:

a first idling pulley adjacent said drum;

a second idling pulley adjacent said drum;

a bellcrank pivotally connected to said frame;

a third idling pulley carried by one arm of said bellcrank; and a biasing means interconnecting the arm of said bell crank and said frame to lever said third pulley away from said first and second pulleys to tension said flexible gripping means passing around said pulleys.

5. An apparatus for reclaiming tobacco and paper from cigarettes as defined in claim 1 wherein said recovering means (g) is comprised of:

a tobacco chute disposed opposite said intermediate station to receive tobacco as ejected from each cigarette for conveyance to a remote storage location;

a final air jetting means connected to said frame at a third station for directing a final jet of air against said receiving end of each now empty cigarette to eject the remaining paper tube from said conveying means; and a paper chute disposed opposite said intermediate station to receive paper tubes remaining after the tobacco has been ejected as the tubes are ejected from said conveying means for conveyance to a remote storage location.

6. An apparatus for reclaiming tobacco and paper from cigarettes as defined in claim 5 wherein said conveying means (c) is further comprised of an arcuate retaining means connected to said frame in essentially coextensive relation to said flexible gripping means in juxtaposition to said drum, said retaining means, however, extending beyond said flexible retaining means in the direction of rotation of said drum for retaining the paper tubes of the cigarettes in said fluting of said drum after the tobacco has been ejected therefrom, after the tubes have progressed beyond the arcuate segment of said flexible gripping means associated with said drum, but before recovery of the remaining paper tubes by said recovering means.

7. a method of reclaiming tobacco and paper from cigarettes comprising the steps of:

(a) withdrawing cigarettes consecutively from a hopper;

(b) pneumatically positioning each cigarette relative to a conveying system, including the step of;

(c) essentially hermetically sealing a receiving end of each cigarette in axially abutting relation with a sealing plate carrying air under pressure; by (d) axially restraining each cigarette relative to the sealing plate;

(e) translating each cigarette from abutment with a first to a second location on said sealing plate, the second location being nearer the end of the axially restrained cigarette opposite said receiving end than the first location and thus more tightly in abutment with said receiving end of each cigarette;

(f) directing a jet of air from an orifice in the sealing plate through said receiving end of each cigarette to develop a sufficient pressure differential across the length of the cigarette to eject the tobacco from the surrounding paper tube of the cigarette; and (g) pneumatically ejecting into a chute the paper tube remaining after the tobacco has been removed from each cigarette.

8. The method of reclaiming tobacco and paper from cigarettes as defined in claim 7 further comprising the steps of:

conveying the tobacco removed from each cigarette to a remote sotrage location; and conveying each paper tube to a remote storage location.

9. A method of reclaiming tobacco and paper from cigarettes as defined in claim 8 wherein said step of pneumatically positioning each cigarette is comprised of the step of directing a jet of air against the end of each cigarette opposite said receiving end to axially translate the cigarette into axial abutment with the sealing plate.

10. A method of reclaiming tobacco and paper from cigarettes as defined in claim 8, wherein said step of axially restraining each cigarette is comprised of the step of laterally gripping each cigarette with a continuous, elastomeric belt.

11. A method of reclaiming tobacco and paper from cigarettes as defined in claim 8 wherein said step of pneumatically ejecting each paper tube remaining after the tobacco has been removed is comprised of:

releasing the paper tube from axial restraint; relatively loosely restraining the paper tube laterally; and directing a jet of air against said receiving end of the now empty cigarette to eject into the chute the paper tube remaining.

* * * * *